US010108108B2

(12) United States Patent
Seki et al.

(10) Patent No.: US 10,108,108 B2
(45) Date of Patent: Oct. 23, 2018

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Hiroyuki Seki, Suntou-gun (JP); Takayoshi Kihara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/473,264

(22) Filed: Mar. 29, 2017

(65) Prior Publication Data

US 2017/0285526 A1 Oct. 5, 2017

(30) Foreign Application Priority Data

Mar. 30, 2016 (JP) ..... 2016-069284

(51) Int. Cl.
*G03G 15/08* (2006.01)

(52) U.S. Cl.
CPC ..... *G03G 15/0881* (2013.01); *G03G 15/0812* (2013.01)

(58) Field of Classification Search
CPC ..... G03G 15/0812; G03G 15/0881
See application file for complete search history.

(56) References Cited

U.S. PATENT DOCUMENTS 5,185,632 A * 2/1993 Yoshida ..... G03G 15/0812 399/284

FOREIGN PATENT DOCUMENTS

JP 11-272067 A 10/1999

* cited by examiner

*Primary Examiner* — Gregory H Curran
(74) *Attorney, Agent, or Firm* — Canon U.S.A., Inc. IP Division

(57) ABSTRACT

A regulation member includes an opposed surface and a contact surface in a portion corresponding to an image forming area. The opposed surface is opposed to a developer bearing member. The contact surface protrudes from the opposed surface and has a height different from that of the opposed surface. An end seal seals a gap between a frame body, the developer bearing member, and the regulation member. The regulation member further includes an area not having the contact surface between the image forming area and a sealing area in which the regulation member and the end seal overlap. In the sealing area, a step between the opposed surface and the contact surface has a height of greater than or equal to 0 mm and not greater than 0.10 mm.

12 Claims, 14 Drawing Sheets

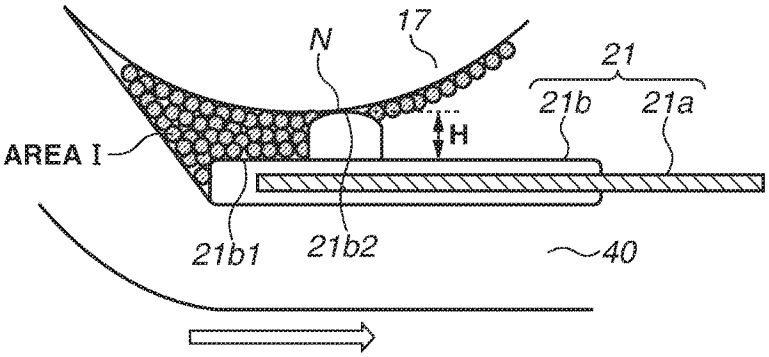
FIG.10A
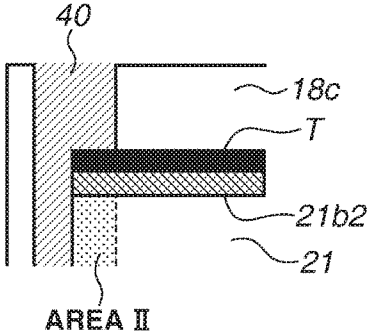
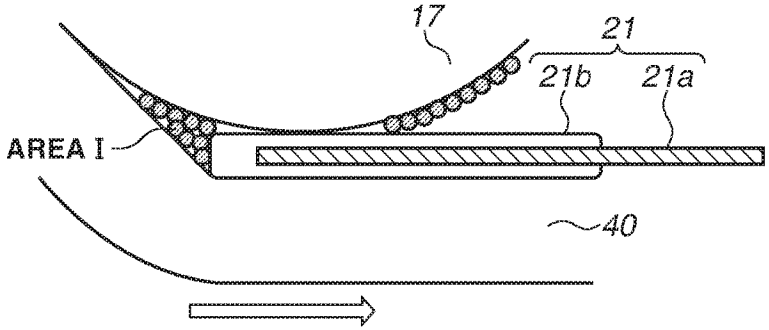
FIG.10B
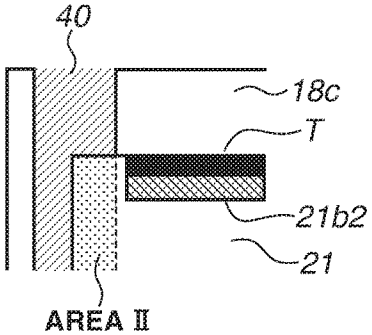

LEADING EDGE DENSITY STABILITY OF IMAGE FORMING AREA

TONER LEAKAGE FROM SEALING AREAS

DEVELOPING DEVICE, PROCESS CARTRIDGE, AND IMAGE FORMING APPARATUS

BACKGROUND OF THE INVENTION

Field of the Invention

The present disclosure relates to an image forming apparatus using an electrophotographic method, such as a copying machine, a printer, and a facsimile. In particular, the present invention relates to a developing device and a process cartridge used in the image forming apparatus.

Description of the Related Art

Printers and other image forming apparatuses using an electrophotographic image forming method (electrophotographic process) have been widely used for practical applications. Such image forming apparatuses perform image formation in the following manner.

Initially, an electrophotographic photosensitive member (hereinafter, photosensitive member) serving as an image bearing member is uniformly charged. Next, the charged photosensitive member is selectively exposed to form an electrostatic image on the photosensitive member. The electrostatic image is visualized as a toner image with developer (toner). The developer image (toner image) formed on the photosensitive member is then transferred to a recording material such as a recording sheet and a plastic sheet. Heat and/or pressure is applied to the developer image transferred onto the recording material, whereby the developer image is fixed to the recording material for image formation.

Such an image forming apparatus typically needs maintenance of various process units. To facilitate the maintenance of the process units, a photosensitive drum, a charging unit, a developing unit, and a cleaning unit are often integrated into a frame member to form a process cartridge that is detachably attachable to the image forming apparatus (apparatus main body). According to such a process cartridge system, an image forming apparatus having excellent usability can be provided.

For such an image forming apparatus, it has been contemplated to use a developing device of a pressure development method in which a regulation member for regulating the developer is brought into contact with a developing roller. For example, there has been discussed a configuration for solving a problem that the regulation member of the developing device fails to accurately form a thin film layer of toner having a predetermined thickness and produces a streak or scrape in the thin film layer of toner on the developing roller (Japanese Patent Application Laid-Open No. 11-272067).

This configuration uses a developing blade (regulation member) that includes a contact surface to be pressed against the developing roller and an opposed surface to be opposed to the developing roller with a predetermined space therebetween. The contact surface is located downstream of a step protruding in a direction orthogonal to a rotation axis direction of the developing roller. The opposed surface is located upstream of the step. The use of the developing blade can improve regulation capability for forming a uniform thin film layer of toner, whereby density can be stabilized and adhesion of the developer to the developing blade can be prevented. Stable image quality can be obtained without a streak or other image defects due to secular changes.

However, a study made by the present inventor has found that the configuration for sealing gaps between the regulation member and the developing frame member and between the developing roller and the developing frame member with end seals at longitudinal ends may cause toner leakage.

SUMMARY OF THE INVENTION

According to an aspect of the present invention, a developing device includes a frame member configured to accommodate developer, a developer bearing member rotatably supported in an opening of the frame member and configured to bear and convey the developer, a regulation member configured to make contact with the developer bearing member and regulate the developer to a predetermined layer thickness, and an end seal fixed to a longitudinal end of the opening of the frame member and configured to seal a gap between the frame member, the developer bearing member, and the regulation member. The regulation member includes an opposed surface and a contact surface at least in a portion corresponding to an image forming area, the opposed surface being opposed to the developer bearing member, the contact surface protruding from the opposed surface and having a height different from that of the opposed surface. The regulation member further includes an area not having the contact surface between the image forming area and a sealing area in which the regulation member and the end seal overlap. In the sealing area, a step between the opposed surface and the contact surface has a height of greater than or equal to 0 mm and not greater than 0.10 mm.

Further features of the present invention will become apparent from the following description of exemplary embodiments with reference to the attached drawings.

BRIEF DESCRIPTION OF THE DRAWINGS

FIGS. 10A and 10B are diagrams schematically illustrating a vicinity of the end seal according to the first exemplary embodiment.

DESCRIPTION OF THE EMBODIMENTS

A developing device, a process cartridge, and an image forming apparatus according to an exemplary embodiment of the present invention will be described in further detail below with reference to the drawings.

<Overall Schematic Configuration of Image Forming Apparatus>

An overall configuration of an electrophotographic image forming apparatus (hereinafter, image forming apparatus) according to the exemplary embodiment of the present invention will initially be described.

Figure 1:
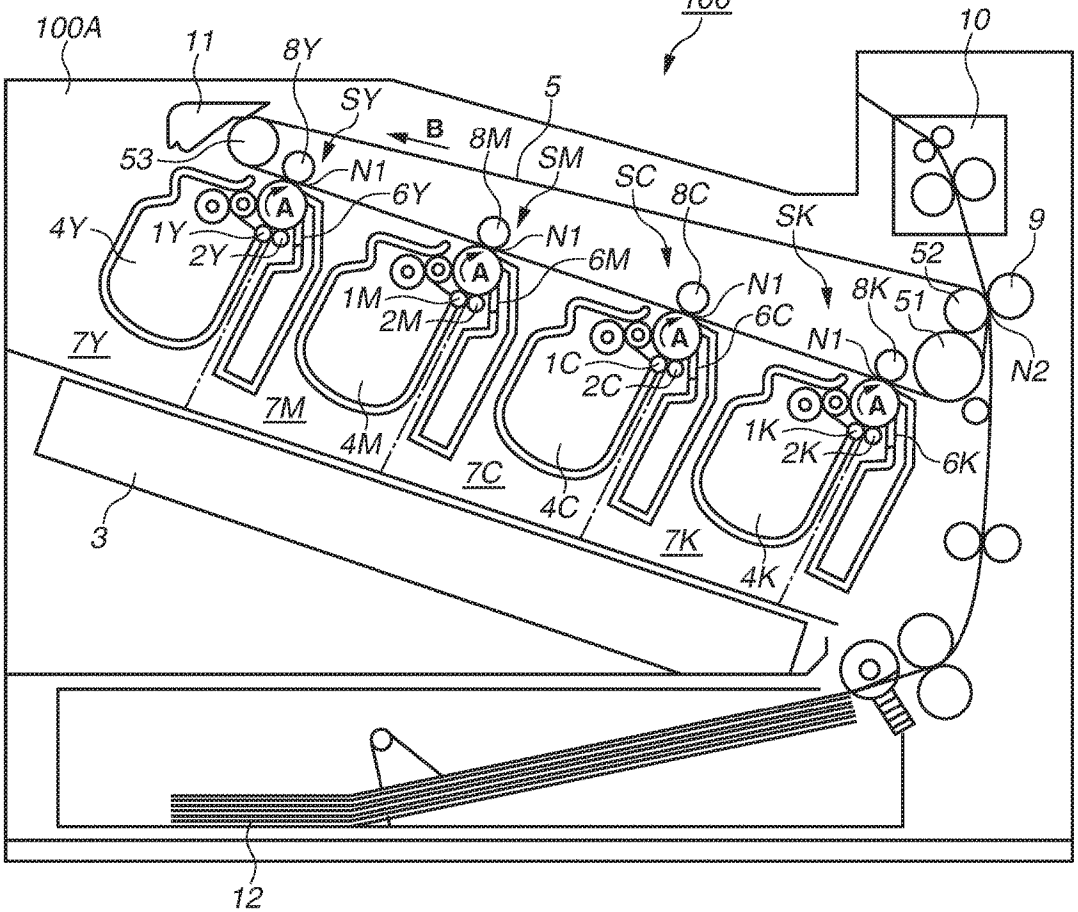
FIG. 1 is a schematic cross-sectional view of an image forming apparatus according to a first exemplary embodiment.

FIG. 1 is a schematic cross-sectional view of an image forming apparatus 100 according to the present exemplary embodiment. The image forming apparatus 100 according to the present exemplary embodiment is a full-color laser printer using an inline method and an intermediate transfer method. The image forming apparatus 100 can form a full-color image on a recording material (such as a recording sheet, a plastic sheet, and cloth) according to image information. The image information is input to an image forming apparatus main body 100A from an image reading apparatus or a host apparatus such as a personal computer which is communicably connected to the image forming apparatus main body 100A.

The image forming apparatus 100 includes a plurality of image forming units, including a first, second, third, and fourth image forming units SY, SM, SC, and SK for forming color images in yellow (Y), magenta (M), cyan (C), and black (K), respectively. In the present exemplary embodiment, the first to fourth image forming units SY, SM, SC, and SK are arranged in a row in a direction intersecting with a vertical direction.

In the present exemplary embodiment, the first to fourth image forming units SY, SM, SC, and SK have substantially the same configurations and make substantially the same operations except in the color of the images to form. For comprehensive description, the suffixes Y, M, C, and K attached to the reference symbols to indicate which color the elements are provided for will therefore be omitted below unless particular distinction is needed.

In the present exemplary embodiment, the image forming apparatus 100 includes four drum-shaped electrophotographic photosensitive members, or photosensitive drums 1, which are arranged in a row in the direction intersecting with the vertical direction as a plurality of image bearing members. Each photosensitive drum 1 is driven to rotate in the direction of the arrow A in the diagram (clockwise) by a not-illustrated driving unit (drive source). A charging roller 2, a scanner unit (exposure device) 3, a developing unit (developing device) 4, and a cleaning member 6 arranged around the photosensitive drum 1. The charging roller 2 is a charging unit which uniformly charges the surface of the photosensitive drum 1. The scanner unit 3 is an exposure unit which irradiates the photosensitive drum 1 with laser to form an electrostatic image (electrostatic latent image) thereon based on the image information. The developing unit 4 develops the electrostatic image as a developer (hereinafter, toner) image. The cleaning member 6 is a cleaning unit which removes toner (transfer residual toner) remaining on the surface of the photosensitive drum 1 after transfer.

The photosensitive drum 1 and the charging roller 2, the developing unit 4, and the cleaning member 6 serving as process units acting on the photosensitive drum 1 are integrated into a process cartridge 7. The process cartridge 7 is detachably attachable to the image forming apparatus 100 via mount units such as a mount guide and a positioning member which are arranged on the image forming apparatus main body 100A.

An intermediate transfer belt 5 serving as an intermediate transfer member for transferring the toner images on the four photosensitive drums 1 to a recording material 12 is arranged opposite to the photosensitive drums 1. The intermediate transfer belt 5 is made of an endless-shaped belt. The intermediate transfer belt 5 is in contact with all the photosensitive drums 1 and moves to circulate (rotate) in the direction of the arrow B in the diagram (counterclockwise). The intermediate transfer belt 5 is stretched across a plurality of support members, including a drive roller 51, a secondary transfer counter roller 52, and a driven roller 53. An intermediate transfer belt cleaning device 11 for removing remaining secondary transfer residual toner is arranged on the intermediate transfer belt 5.

Four primary transfer rollers 8 serving as primary transfer units are arranged in a row on an inner periphery side of the intermediate transfer belt 5 so that the primary transfer rollers 8 are opposed to the respective photosensitive drums 1. The primary transfer rollers 8 press the intermediate transfer belt 5 toward the photosensitive drums 1 to form primary transfer portions N1 in which the intermediate transfer belt 5 and the photosensitive drums 1 make contact with each other.

A secondary transfer roller 9 serving as a secondary transfer unit is arranged on an outer periphery side of the intermediate transfer belt 5 in a position opposed to the secondary transfer counter roller 52. The secondary transfer roller 9 is pressed against the secondary transfer counter roller 52 with the intermediate transfer belt 5 therebetween. The secondary transfer roller 9 thereby forms a secondary transfer portion N2 in which the intermediate transfer belt 5 and the secondary transfer roller 9 make contact with each other.

The recording material 12 to which the toner images are transferred is conveyed to a fixing device 10 serving as a fixing unit. The fixing device 10 applies heat and pressure to the recording material 12, whereby the toner images are fixed to the recording material 12.

The image forming apparatus 100 is configured so that only one desired image forming unit or some (not all) of the image forming units can be used to form a monochrome or multi-color image as well.

<Image Forming Process>

In forming an image, the surface of the photosensitive drum 1 is initially uniformly charged by the charging roller 2. The charged surface of the photosensitive drum 1 is scanned by and exposed to laser light emitted from the scanner unit 3 according to image information, whereby an electrostatic image according to the image information is formed on the photosensitive drum 1. The electrostatic image formed on the photosensitive drum 1 is then developed as a toner image by the developing unit 4. A not-illustrated primary transfer voltage power supply (high-voltage power supply) serving as a primary transfer voltage application unit applies a voltage of polarity opposite to normal charging polarity of the toner to the primary transfer roller 8. The toner image on the photosensitive drum 1 is thereby primarily transferred onto the intermediate transfer belt 5. In forming a full-color image, the foregoing process is performed by the first to fourth image forming units SY, SM, SC, and SK in succession, whereby the toner images of the respective colors are primarily transferred to the intermediate transfer belt 5 on one another.

A recording material 12 is then conveyed to the secondary transfer portion N2 in synchronization with the movement of the intermediate transfer belt 5. A non-illustrated secondary transfer voltage power supply (high-voltage power supply) serving as a secondary transfer voltage application unit then applies a voltage of polarity opposite to the normal charging polarity of the toner to the second transfer roller 9. The four color images on the intermediate transfer belt 5 are thereby secondarily transferred together onto the recording material 12 conveyed by a feeding unit, by the action of the secondary transfer roller 9 which is in contact with the intermediate transfer belt 5 with the recording material 12 therebetween.

The recording material 12 to which the toner images are transferred is conveyed to the fixing device 10 serving as the fixing unit. The fixing device 10 applies heat and pressure to the recording material 12, whereby the transferred toner images are fixed to the recording material 12. The recording material 12 is discharged from the image forming apparatus 100.

Primary transfer residual toner remaining on the photosensitive drums 1 after the primary transfer step is removed and collected by the cleaning members 6. Secondary transfer residual toner remaining on the intermediate transfer belt 5 after the second transfer step is removed by the intermediate transfer belt cleaning device 11.

The developing units 4 perform reversal development by bringing developing rollers (to be described below) serving as developer bearing members into contact with the photosensitive drums 1. More specifically, the developing units 4 is used to develop an electrostatic image by causing toner charged with the same polarity as the charging polarity of the photosensitive drums 1 (in the present exemplary embodiment, negative polarity) to adhere to portions (image portions or exposed portions) in which charges are attenuated by exposure on the photosensitive drums 1.

<Configuration of Process Cartridges>

Next, an overall configuration of the process cartridges 7 mounted on the image forming apparatus 100 according to the present exemplary embodiment will be described. The process cartridges 7 for the respective colors have the same shape except in a not-illustrated identification portion. The developing units 4 of the process cartridges 7 for the respective colors contain toner of the respective colors Y, M, C, and K. The developing units 4 use nonmagnetic one-component developer toner as the developer.

Figure 2:
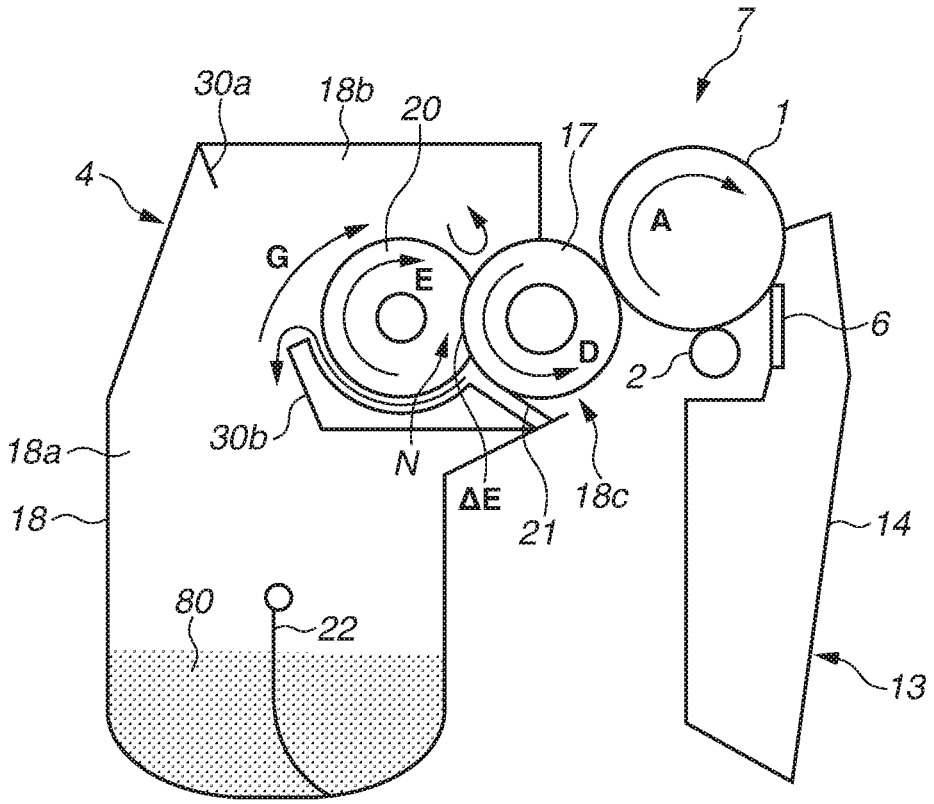
FIG. 2 is a schematic cross-sectional view of a process cartridge according to the first exemplary embodiment.

FIG. 2 is a schematic cross-sectional view (main cross section) of each process cartridge 7 according to the present exemplary embodiment, seen in a longitudinal direction (rotation axis direction) of the photosensitive drum 1. FIG. 2 illustrates the process cartridge 7 in an orientation such that the process cartridge 7 is mounted on the image forming apparatus main body 100A. A positional relationship and directions of members of the process cartridge 7 will hereinafter be referred to in terms of the positional relationship and the directions in such an orientation.

The process cartridge 7 is configured by integrating a photosensitive unit 13 and the developing unit 4. The photosensitive unit 13 includes the photosensitive drum 1. The developing unit 4 includes a developing roller 17 which is rotatable.

The photosensitive unit 13 includes a cleaning frame member 14 serving as a frame member for supporting various elements in the photosensitive unit 13. The photosensitive drum 1 is rotatably attached to the cleaning frame member 14 via not-illustrated bearings. Drive force of the not-illustrated driving unit (drive source) is transmitted to the photosensitive unit 13, whereby the photosensitive drum 1 is driven to rotate in the direction of the arrow A in the diagram (clockwise) according to an image forming operation.

The photosensitive unit 13 includes the cleaning member 6 and the charging roller 2 which are arranged in contact with the peripheral surface of the photosensitive drum 1. Transfer residual toner removed from the surface of the photosensitive drum 1 by the cleaning member 6 falls and is accommodated in the cleaning frame member 14. The charging roller 2 serving as the charging unit includes a roller portion made of conductive rubber. The roller portion is pressed against the photosensitive drum 1, whereby the charging roller 2 is driven to rotate.

The developing unit 4 includes the developing roller 17, a toner supply roller (supply member) 20, a developing blade (regulation member) 21, and a developing frame member 18. The developing roller 17 bears toner 80. The toner supply roller 20 supplies the toner 80 to the developing roller 17. The developing frame member 18 fixes the rollers and the members. The developing frame member 18 includes a toner accommodation chamber (developer accommodation chamber) 18*a*, a developing chamber 18*b*, and a development opening (opening) 18*c*. The toner accommodation chamber 18*a* accommodates the toner 80. The developing roller 17 and the toner supply roller 20 are arranged in the developing chamber 18*b*. The development opening 18*c* leads to the outside from the developing chamber 18*b*.

The developing roller 17 is arranged in the development opening 18*c* and can make contact with the photosensitive drum 1 of the photosensitive unit 13. An end of the developing blade 21 is fixed to the development opening 18*c*. The other end of the developing blade 21 is put in contact with the developing roller 17 so that the developing blade 21 can regulate a coating amount of the toner 80 on the developing roller 17 and give a charge to the toner 80.

In the present exemplary embodiment, the developing roller 17 and the photosensitive drum 1 are rotated so that their respective surfaces move in the same direction (in the present exemplary embodiment, direction from below to above in the direction of gravity) at the opposed portion. A predetermined direct-current voltage is applied to the developing roller 17 so that the toner 18 is charged to be more negative than by frictional charging. The charged toner 18 is used to visualize the electrostatic latent image to form a toner image in a developing portion in which the developing roller 17 makes contact with the photosensitive drum 1. In the present exemplary embodiment, the developing roller 17 is arranged in contact with the developing drum 1. However, the developing roller 17 may be arranged adjacent to the photosensitive drum 1 at a predetermined gap.

The developing chamber 18*b* holds the toner supply roller 20 so that the toner supply roller 20 rotates in contact with the developing roller 17. The toner supply roller 20 and the developing roller 17 rotate in such directions that their respective surfaces move from a top end to a bottom end of a nip portion N. Specifically, the toner supply roller 20 rotates in the direction of the arrow E in the diagram (clockwise). The developing roller 17 rotates in the direction of the arrow D. The toner supply roller 20 is an elastic sponge roller having a foam layer formed on the outer periphery of a conductive core. The toner supply roller 20 is configured to deform by an amount of recess ΔE in the nip portion N with the developing roller 17 when the developing roller 17 makes contact with the toner supply roller 20.

In the nip portion N, the toner supply roller 20 and the developing roller 17 rotate in the same direction with a peripheral speed difference from each other. By such an operation, the toner supply roller 20 supplies the toner 80 to the developing roller 17. Here, a potential difference between the toner supply roller 20 and the developing roller 17 can be adjusted to adjust the amount of toner supplied to the developing roller 17.

An agitation conveyance member 22 is arranged in the toner accommodation chamber 18*a*. The toner accommodation chamber 18*a* and the developing chamber 18*b* are sectioned by partitions 30*a* and 30*b*. An opening is formed between the partitions 30*a* and 30*b*. The agitation conveyance member 22 agitates the toner 80 accommodated in the toner accommodation chamber 18*a*. The agitation conveyance member 22 can also convey the toner 80 from the toner accommodation chamber 18*a* to above the toner supply roller 20, which lies above in the direction of gravity in the developing chamber 18*b*, through the opening in the direction of the arrow G in the diagram.

Figure 3A:
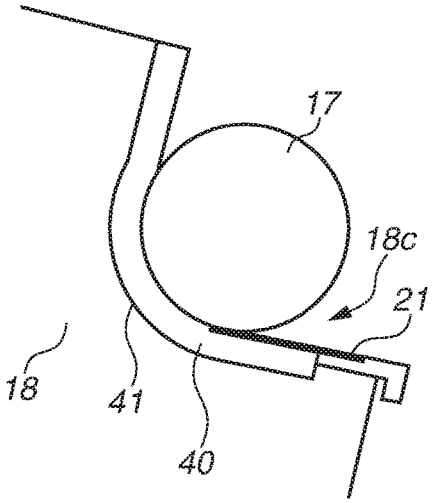
FIGS. 3A and 3B are diagrams illustrating an end seal configuration according to the first exemplary embodiment.

Next, a toner seal configuration of the developing unit 4 according to the present exemplary embodiment will be described with reference to FIGS. 3A to 5. As illustrated in FIG. 3A, an arc-shaped bonding seat 41 of an end seal 40 is arranged at each of both longitudinal ends of the development opening 18*c* in the developing frame member 18. The end seal 40 is arranged on each of the bonding seats 41. The end seal 40 is a flexible member having felt, pile of woven fibers, or electrostatic flocking at the surface. Part of the end seal 40 overlaps with the developing blade 21 in the longitudinal direction and fills a gap between the developing frame member 18 and the developing blade 21. More specifically, the peripheral surface of the developing roller 17 and the back surface of the developing blade 21 (the surface opposite from the contact surface with the developing roller 17) are pressed against the end seal 40 fixed to the developing frame member 18, whereby the toner 80 is prevented from leaking out of the developing frame member 18 in the longitudinal direction.

Figure 3B:
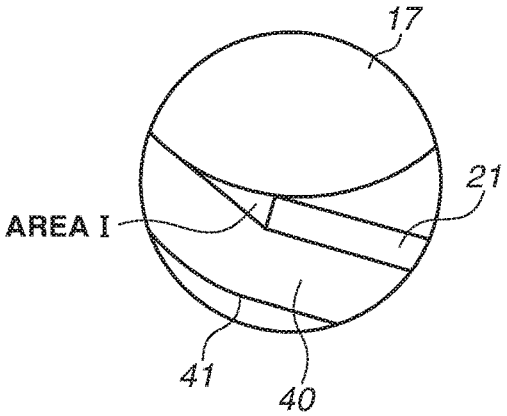
Figure 4:
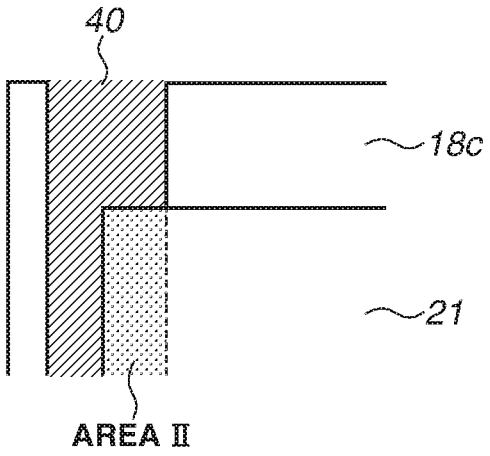
FIG. 4 is a diagram illustrating a relationship between longitudinal ends according to the first exemplary embodiment.

As illustrated in FIG. 4, at each end, the developing blade 21 and the end seal 40 overlap in an area II. As illustrated in FIG. 3B, an area I formed by the developing blade 21, the developing roller 17, and the end seal 40 is filled with the end seal 40 which is compressed by the developing roller 17 and the developing blade 21.

Figure 5:
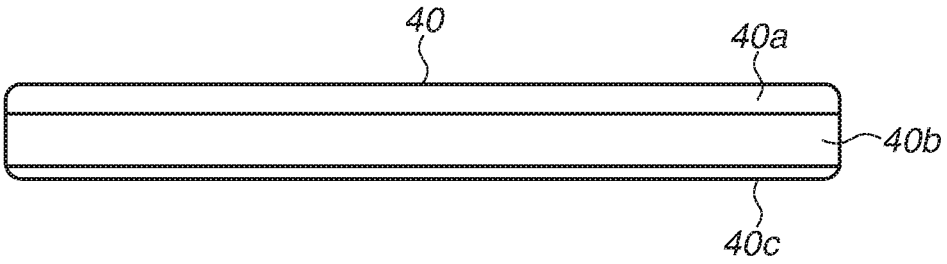
FIG. 5 is a diagram for describing an end seal according to the first exemplary embodiment.

FIG. 5 illustrates a cross-sectional view of the end seal 40 according to the present exemplary embodiment. As illustrated in FIG. 5, the end seal 40 includes three layers which are a surface layer 40*a*, an intermediate layer 40*b*, and an adhesive layer 40*c*. The surface layer 40*a* is 1.9-mm-thick pile fabric having a Japanese Industrial Standard (JIS)-A hardness of 34°. The intermediate layer 40*b* is a 3.0-mm-thick foam layer of urethane foam having a JIS-A hardness of 12°. The adhesive layer 40*c* is a 0.05-mm-thick two-sided adhesive tape.

<Configuration of Developing Blade>

Figure 6:
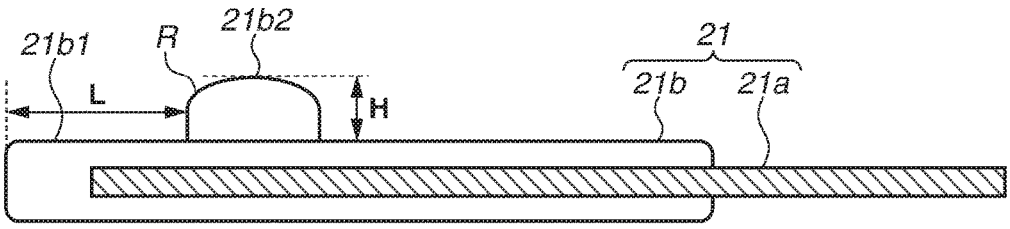
FIG. 6 is a diagram illustrating a shape of a developing blade according to the first exemplary embodiment.

A configuration of the developing blade 21 according to the present exemplary embodiment will be described in detail with reference to FIG. 6. The developing blade 21 is in contact with the developing roller 17 in a counter manner, and regulates the coating amount of the toner 80 supplied by the toner supply roller 20 and gives a charge to the toner 80.

In the present exemplary embodiment, the developing blade 21 includes a support portion 21*a* which is made of a plate spring-like stainless steel plate having a thickness of 0.1 mm. Spring elasticity of the support portion 21*a* is used to bring the surface of a blade portion 21*b* into contact with the developing roller 17. The developing blade 21 is not limited to such an exemplary embodiment. For example, the support portion 21*a* may be a metal thin plate of phosphor bronze or aluminum instead of the stainless steel plate. The blade portion 21*b* is formed by coating the surface of the support portion 21*a* with a thin film of polyamide elastomer, urethane rubber, or urethane resin.

In the present exemplary embodiment, the blade portion 21*b* includes an opposed surface 21*b*1 and a contact surface 21*b*2. The opposed surface 21*b*1 is opposed to the developing rollers 17 with a predetermined space therebetween. The contact surface 21*b*2 protrudes from the opposed surface 21*b*1 and has a height different from that of the opposed surface 21*b*1. More specifically, a protrusion protruding from the opposed surface 21*b*1 of the developing blade 21 is formed so that there is a step having a height of H (mm) between the contact surface 21*b*2 in contact with the development roller 17 and the opposed surface 21*b*1. In other words, the distance between the contact surface 21*b*2 and the opposed surface 21*b*1 is H (mm) (the contact surface 21*b*2 has a maximum height H). The length from the tip of the developing blade 21 on the blade portion 21*b* side to the step constituting the protruded contact surface 21*b*2 is L (mm) (hereinafter, length L). The portion that leads to the contact surface 21*b*2 and is convex outward has a radius of curvature of R (mm). it is preferable that the radius of curvature R is 1.00 mm or greater so that the developing blade 21 makes stable contact with the developing roller 17 with a constant contact width. In the present exemplary embodiment, such a configuration provides a nip width of 0.6 to 0.8 mm between the blade portion 21*b* and the developing roller 17 when the blade portion 21*b* is brought into contact with the developing roller 17 by a force of 40 gf/cm.

Sliding between the contact surface 21*b*2 of the developing blade 21 and the developing roller 17 triboelectrically charges the toner 80 and regulates the thickness of the toner 80. In the present exemplary embodiment, a predetermined voltage is also applied to the developing blade 21 from a not-illustrated blade voltage power supply for the sake of stabilization of the toner coating.

Figure 7:
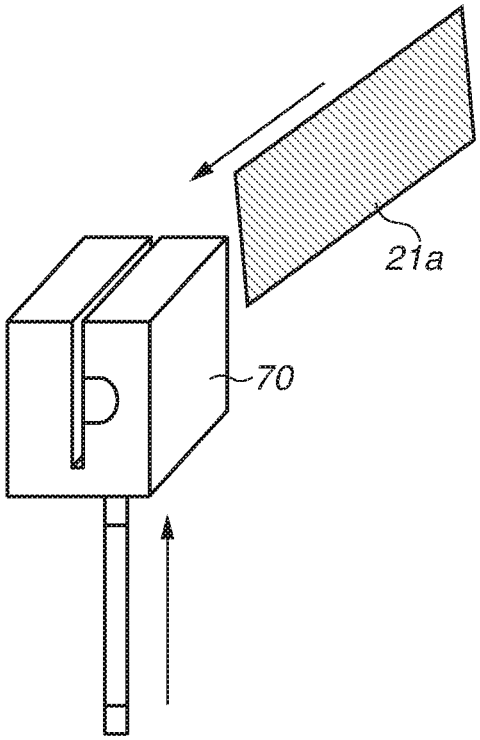
FIG. 7 is a diagram illustrating a method for forming the development blade according to the first exemplary embodiment.

Next, a method for forming the development blade 21 according to the present exemplary embodiment will be described with reference to FIG. 7.

The support portion 21*a* made of a plate spring-like stainless steel plate having a width of approximately 1 mm is conveyed at a constant speed and passes through a mold 70 that is machined to a blade end shape. As the support portion 21*a* passes through the mold 70, molten resin is injected into the mold 70 at constant pressure, whereby the blade portion 21*b* of desired shape is integrally molded on the tip part of the support portion 21*a*. The molded article that has passed the mold 70 is then cooled and cut into the developing blade 21 of desired length.

The tip shape of the developing blade 21 varies depending on conditions such as the setting of the conveyance speed and the viscosity and fluidity of the liquid resin. The fabrication using the foregoing configuration enables stable formation of the developing blade 21 having a uniform tip shape in the longitudinal direction. In the present exemplary embodiment, the developing blade 21 is continuously formed in the mold 70 by integrating thermoplastic resin with the thin plate of stainless steel. This not only stabilizes the precision of the tip shape but also can improve the productivity of the developing blade 21.

The developing blade 201 here is described to be fabricated by using thermoplastic resin. However, this is not restrictive, and thermosetting resin may be used. In such a case, after the thin plate is inserted in a mold previously machined to the tip shape, the resin is injected and heated to cure. The molded article can then be released from the mold to fabricate a developing blade that is longitudinally uniform and has a precise tip shape.

In the present exemplary embodiment, the blade portion 21*b* is described to be formed on the support portion 21*a* before cutting. However, this is not restrictive. For example, the developing blade 21 may be formed by fixing a separately-formed blade portion 21*b* to a predetermined position of a metal plate of a predetermined length to be the support portion 21*a* by using yttrium aluminum garnet (YAG) laser, a two-sided adhesive tape, or a hot melt adhesive.

<Mechanism for Improving Development Ghost>

Figure 8:
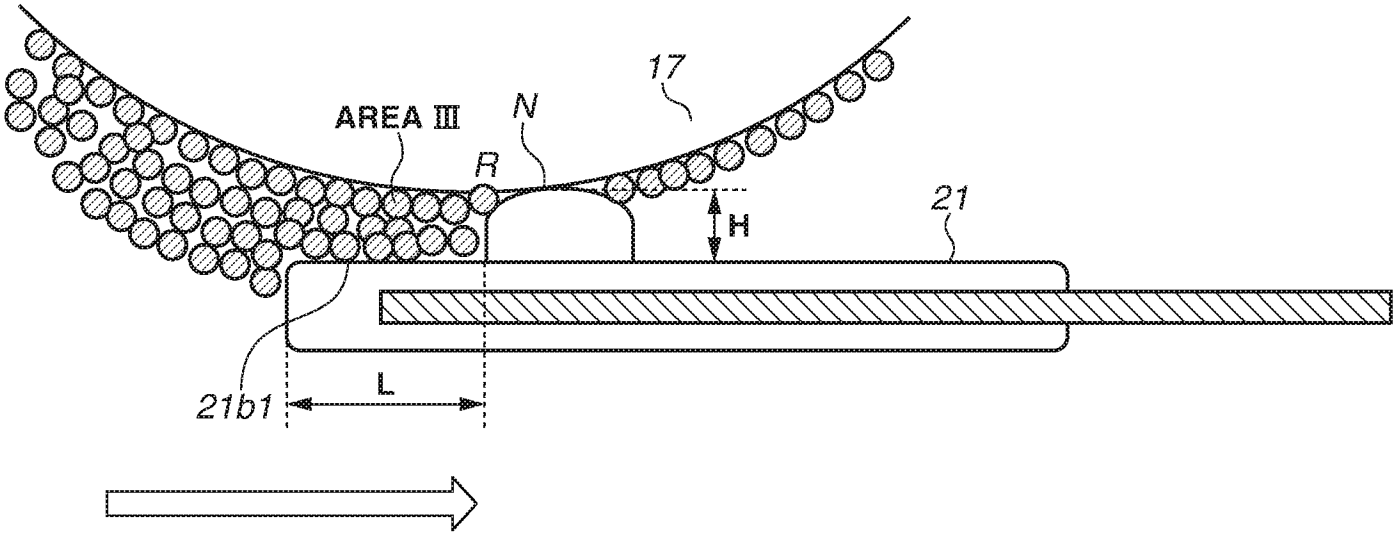
FIG. 8 is a cross-sectional view schematically illustrating a vicinity of a toner regulation portion according to the first exemplary embodiment.

A mechanism for improving a development ghost according to the present exemplary embodiment will be described with reference to FIG. 8. FIG. 8 is an enlarged sectional view of a toner regulation portion in which the developing roller 17 and the developing blade 21 make contact with each other.

A development ghost can be caused by the occurrence of a large difference in the charge amount of the toner on the developing roller 17 between when a solid white image is printed without consuming the toner and after an image of high printing ratio, such as a solid image, which consumes a large amount of toner on the developing roller 17 is output.

In FIG. 8, the toner that has passed through the nip portion N between the toner supply roller 20 and the developing roller 17 is conveyed as a pre-coating on the developing roller 17. As the conveyed toner passes the developing blade 21, the toner is regulated into a toner coat layer. The opposed surface 21*b*1 having a length of L (mm) and the protrusion having a height of H (mm) of the developing blade 21 form an area III (wedge portion), in which toner failing to pass due to the layer regulation is retained in a compact state. If the toner remains in the compact state, the toner particles accumulated in the area III, including ones of development residual toner adhering to the developing roller 17, change places frequently. This increases rubbing and facilitates charge exchange between the toner particles, including those of development residual toner and those which are likely to be in a high charge state, such as ones having small particle diameters. As a result, a destaticizing effect for reducing toner particles having high charges can be obtained.

As a result, the particle size selectivity of the toner on the developing roller 17 that has passed the developing blade 21 can be suppressed regardless of the amount or the charge state of the developer toner.

Figure 9A:
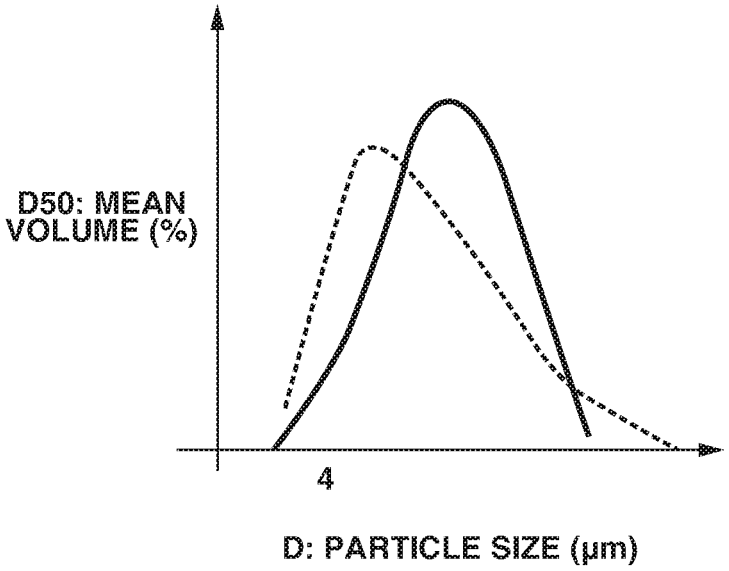
FIGS. 9A and 9B are charts illustrating particle size distributions of particles on a developing roller according to the first exemplary embodiment.
Figure 9B:
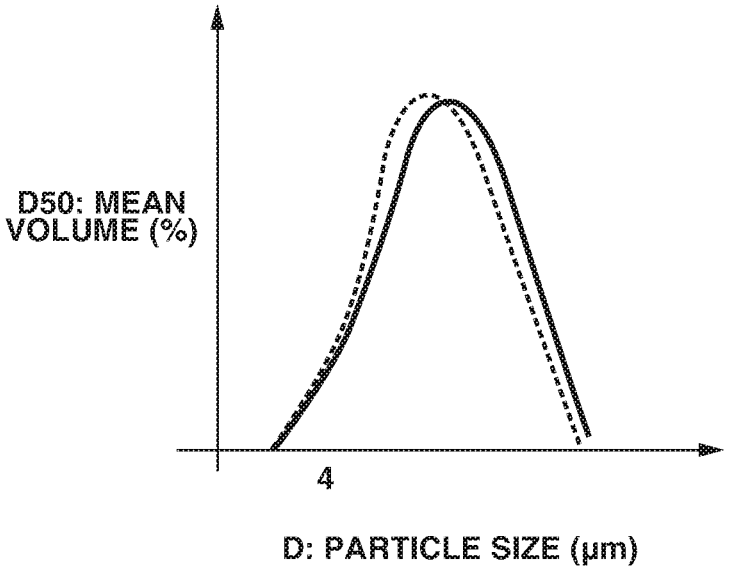

FIGS. 9A and 9B illustrate particle size distributions of the toner on the developing roller 17 that has passed the developing blade 21 according to the present exemplary embodiment. FIG. 9A illustrates the particle size distributions of the developing roller 17 after printing of a solid white image and after printing of a solid black image if the developing blade illustrated in FIG. 8, having no protrusion on the toner regulation surface was used as a comparative example. The particle sizes were measured by using Multisizer III manufactured by Beckman Coulter, Inc. Monochrome (black) toner on the developing roller 17 was sampled for measurement.

The horizontal axis indicates the particle diameter D (μm) of the toner. The vertical axis indicates the existence probability (%) of a mean volume diameter (D50). The broken line in FIG. 9A represents the particle size distribution on the developing roller 17 after the printing of a solid white image. The solid line represents the particle size distribution on the developing roller 17 after the printing of a solid black image. It can be seen from FIG. 9A that an average center particle diameter after the printing of a solid white image is smaller than that after the printing of a solid black image. The average center particle diameter of the toner on the developing roller 17 after the printing of a solid white image is 5.4 μm. The ratio of toner fine particles of 4 μm or smaller is found to increase, compared with the particle size distribution after the printing of a solid black image. The average center particle diameter of the toner on the developing roller 17 after the printing of a solid black image is 6.1 μm. It can be seen that the average particle diameter of the toner on the developing roller 17 is smaller after the printing of a solid white image than after the printing of a solid black image. Consequently, the charge amount of the toner on the developing roller 17 is higher after the printing of a solid white image.

FIG. 9B illustrates the particle size distributions on the developing roller 17 after the printing of a solid white image and after the printing of a solid black image when the developing blade 21 illustrated in FIG. 8 according to the present exemplary embodiment, having the protrusion arranged on the toner regulation surface was used.

The relationship between the horizontal axis, the vertical axis, the broken line, and the solid line is the same as in FIG. 9A. It can be seen from FIG. 9B that the particle size distribution of the toner after the printing of a solid white image and that after the printing of a solid black image show similar tendencies. The average center particle diameter of the toner on the developing roller 17 after the printing of a solid white image is 5.9 μm. The average center particle diameter of the toner on the developing roller 17 after the printing of a solid black image is 6.1 μm. It can be seen that if the developing blade 21 according to the present exemplary embodiment is used, the average center particle diameters of the toner on the developing roller 17 after the printing of a solid white image and after the printing of a solid black image are almost the same.

The charge amount of the toner on the developing roller 17 here shows a similar tendency to that of the present exemplary embodiment illustrated in FIG. 9A. Specifically, the charge amount of the toner after the printing of a solid white image is 45 μC/g. The charge amount of the toner after the printing of a solid black image is 40 μC/g. The difference of approximately 5 μC/g means that the charge amounts are much the same.

Consequently, a difference in the charge amount of the toner on the development roller 17 depending on the presence or absence of printing of toner can be suppressed to improve a development ghost.

<Mechanism for Preventing End Toner Leakage>

Next, a mechanism for preventing toner leakage according to the present exemplary embodiment will be described. FIGS. 10A and 10B are enlarged views of the toner regulation portion of the developing blade 21, schematically illustrating cross sections in which the developing roller 17, the developing blade 21, and the toner are in contact. That the diagrams do not represent the exact relationship in size between the portions.

Toner that fails to pass due to the layer regulation lies in the area III in a compact state. To relax the pressure, there occurs lateral running of toner, which refers to that the toner runs over the developing blade 21 from the area III toward outside of areas corresponding to an image forming area at longitudinal ends. The toner running laterally over the development blade 21 eventually reaches the end seals 40 at the longitudinal ends. In the present exemplary embodiment, the image forming area refers to a maximum area in which an electrostatic latent image can be formed on the photosensitive drum 1, or an area of the developing blade 21 or the developing roller 17 corresponding to such an area of the photosensitive drum 1.

As illustrated in FIG. 10A, if the developing blade 21 has the protrusion in the area II where the developing blade 21 and the end seal 40 overlap, the space (area I) covered with the development roller 17, the developing blade 21, and the end seal 40 becomes wide. A larger amount of toner is thus supplied to the end seal 40 along the opposed surface 21*b*1 (brim portion). As a result, the toner is intermittently supplied to the area II where the developing blade 21 and the end seal 40 overlap, while the area I is formed by the developing blade 21. If the traveling force of the toner toward the longitudinal end exceeds the sealing capability of the end seal 40, end toner leakage occurs.

In the present exemplary embodiment, as illustrated in FIG. 10B, the protrusion of the developing blade 21 is then removed to form a flat shape in the area II (sealing area) where the developing blade 21 and the end seal 40 overlap. In other words, the developing blade 21 is configured not to have the contact surface 21*b*2 in the area II. This narrows the area I and reduces the number of toner particles lying in the area I. As a result, the traveling force of the toner toward the longitudinal end can be reduced not to exceed the sealing capability of the end seal 40, whereby the toner accumulated in the area I can be prevented from leaking from the end seal 40.

Figure 11A:
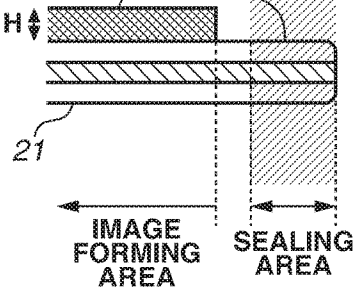
FIGS. 11A, 11B, 11C, 11D, and 11E are diagrams schematically illustrating shapes of the developing blade according to the first exemplary embodiment.
Figure 11B:
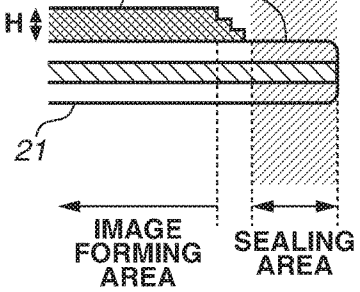
Figure 11C:
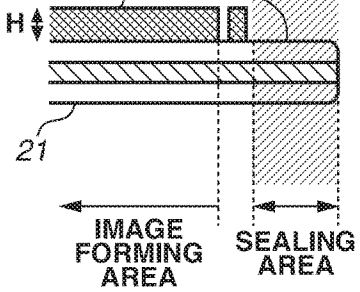
Figure 11D:
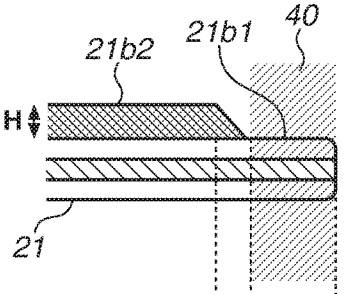
Figure 11E:
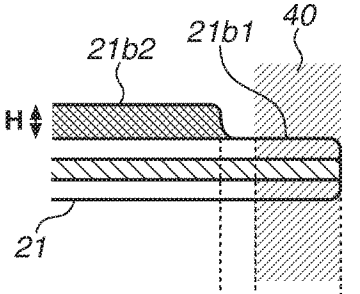

In the present exemplary embodiment, as illustrated in FIG. 11A, the developing blade 21 is configured to have a height of H (distance between the contact surface 21*b*2 and the opposed surface 21*b*1) in the portion corresponding to the image forming area. The developing blade 21 is also configured to have a flat shape of H=0 mm between the image forming area and the sealing area where the developing blade 21 and the end seal 40 overlap, and in the sealing area. In other words, the developing blade 21 is configured not to have the contact surface 21*b*2 between the image forming area and the sealing area or in the sealing area. However, this is not restrictive. For example, as illustrated in FIG. 11B, the developing blade 21 may be configured to have the height H in the image forming area, and the height H may be reduced stepwise toward the overlap area (sealing area) to form a flat shape of H=0 mm in the overlap area. As illustrated in FIG. 11C, a discontinuous protrusion may exist between the image forming area and the overlap area of the end seal 40. As illustrated in FIG. 11D, the height H may be uniformly and continuously reduced toward the overlap area to form a flat shape of H=0 mm in the overlap area. As illustrated in FIG. 11E, the height H may be continuously reduced toward the overlap area to form a flat shape of H=0 mm in the overlap area.

As described above, the presence of the area having a height of H=0 mm, i.e., the area having no contact surface 21*b*2 between the image forming area and the sealing area overlapping with the end seal 40 can prevent toner leakage from the longitudinal end.

<Experiment for Confirming Effect of Present Exemplary Embodiment>

Figure 12:
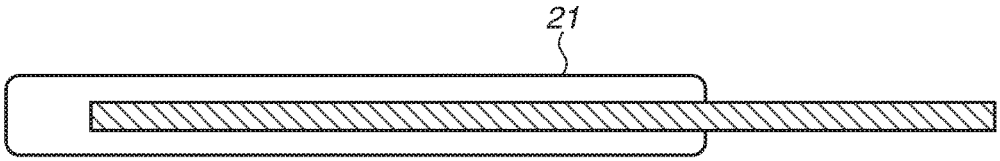
FIG. 12 is a diagram schematically illustrating a shape of a developing blade according to a comparative example.

Several samples having the configuration of the present exemplary embodiment, including an area of H=0 mm between the image forming area and the sealing area where the developing blade 21 and the end seal 40 overlap in the longitudinal direction of the developing blade 21, were fabricated and evaluated. The samples were fabricated with respective different heights H and lengths L. Specifically, the experiment was performed with the following settings. The radius of curvature R (mm) was 1.0 mm. In the image forming area, the height H was changed to range from 0.05 to 0.35 mm, and the length L from 0.15 to 1.50 mm. In the sealing area, the height H was changed to range from 0 to 0.30 mm, and the length L from 0 to 1.50 mm. As a comparative example, a process cartridge having a developing blade configuration illustrated in FIG. 12 was used. A developing blade 210 illustrated in FIG. 12 has a flat shape with no protrusion on the toner regulation surface. The tip is shaped to have a radius of curvature R of 0.2 mm. In the comparative example, the developing blade 210 is configured to make contact with the developing roller 17 at its surface, i.e., to have a surface-abutting configuration. The developing blade 210 is configured so that the length from the tip of the developing blade 210 to the contact position between the developing blade 210 and the developing roller 17 is equivalent to L. In other respects, the configuration of the process cartridge and the overall configuration of the image forming apparatus are similar to those of the present exemplary embodiment.

(1) Evaluation of Leading Edge Density Stability of Solid Image

Image defects (development ghosts) were evaluated in terms of leading edge density stability of a solid image. For evaluation, the amount of decrease in image density in the case of passing a sheet for highly solid printing was measured. In the present exemplary embodiment, as described above, a voltage for electrically facilitating the supply of toner to the developing roller 17 was applied to the toner supply roller 20.

The evaluation was performed on initial images after the image forming apparatuses were left for a day in an evaluation environment of 15° C. and 10% relative humidity (Rh) for accommodation. A printing evaluation test was performed by initially passing of a sheet for a solid white image without consuming toner, and successively outputting of a solid black image. An evaluation was made from a density difference between a leading edge of the output solid black image and a portion of the solid black image after a rotation of the developing roller 17. The measurement was performed by using Spectrodensitometer 500 manufactured by X-Rite, Inc. A monochrome (black) image was output for the printing evaluation test. If the density difference between the leading edge of the solid black image and the portion of the solid black image after a rotation of the developing roller 17 was smaller than 0.2, the leading edge density stability was evaluated as "A". If the density difference was greater than or equal to 0.2 and not greater than 0.3, the leading edge density stability was evaluated as "B". If the density difference was greater than 0.3, the leading edge density stability was evaluated as "C".

(2) Presence or Absence of Toner Blot

After the foregoing evaluation (1), the image forming apparatuses were subjected to a durability test. After the durability test, the image forming apparatuses were disassembled and the image forming areas of the developing blades 21 were inspected and evaluated for toner blots. The durability test was performed by intermittently passing of 10000 sheets to print horizontal lines at an image printing ratio of 0.5% in an evaluation environment of 30° C. and 80% Rh. The intermittent passing of sheets refers to passing of sheets for printing after a standby state each time.

In this evaluation, the occurrence of a "toner blot" refers to a state in which the toner fails to be retained on the developing roller 17 and drops on the developing blade 21 downstream of the toner regulation portion of the developing roller 17. If image formation is continued in the presence of toner blots, the interior of the image forming apparatus and recording sheets can be contaminated to cause deterioration in image quality. Developing blades 21 causing no toner blot were evaluated as "NO". Developing blades 21 causing toner blots were evaluated as "YES".

(3) Presence or Absence of Occurrence of Toner Leakage

After the foregoing evaluation (2), the longitudinal ends of the developing blades 21 were inspected for toner leakage. Developing blades 21 causing no toner leakage at all were evaluated as "NO". Developing blades 21 causing toner leakage were evaluated as "YES".

<Experimental Results>

Table 1 lists the settings and evaluations of the samples.

TABLE 1

| | Image forming area | | | | Sealing area | | |
|---|---|---|---|---|---|---|---|
| | Height H (mm) | Length L (mm) | Leading edge density stability | Toner blot | Height H (mm) | Length L (mm) | Toner leakage |
| Comparative example | 0 | 0 | C | NO | 0 | 0 | NO |
| First exemplary embodiment | 0.05 | 0.15 | A | NO | 0 | 0 | NO |
| | | 0.30 | A | NO | 0.05 | 0.30 | NO |
| | | 1.00 | A | NO | | 1.00 | NO |
| | | 1.50 | A | YES | | 1.50 | NO |
| | 0.10 | 0.15 | A | NO | 0 | 0 | NO |
| | | 0.30 | A | NO | 0.10 | 0.30 | NO |
| | | 1.00 | A | NO | | 1.00 | NO |
| | | 1.50 | A | YES | | 1.50 | NO |
| | 0.15 | 0.15 | B | NO | 0 | 0 | NO |
| | | 0.30 | B | NO | 0.15 | 0.30 | YES |
| | | 1.00 | B | NO | | 1.00 | YES |
| | | 1.50 | B | YES | | 1.50 | YES |
| | 0.30 | 0.15 | B | NO | 0 | 0 | NO |
| | | 0.30 | B | NO | 0.30 | 0.30 | YES |
| | | 1.00 | B | NO | | 1.00 | YES |
| | | 1.50 | B | YES | | 1.50 | YES |
| | 0.35 | 0.15 | C | NO | 0 | 0 | NO |

The result of the comparative example will initially be described. The configuration of the comparative example is confirmed to produce a large difference in the charge amount of the toner on the developing roller between after the printing of a solid white image and after the printing of a solid black image, and thus lower the leading edge density stability.

Next, the results of the present exemplary embodiment will be described. The developing blades 21 used in the present exemplary embodiment are configured to have a protrusion on the toner regulation surface as illustrated in FIG. 7. The results of the leading edge density stability will initially be described.

If the developing blade 21 had a height H of 0.05 to 0.10 mm in the image forming area, the leading edge density stability was successfully improved (rank A) at lengths L of 0.15 to 1.50 mm. At a length L of 1.50 mm, toner blots occurred.

If the height H was 0.15 to 0.30 mm, the leading edge density stability was successfully controlled within an allowable range (rank B) at lengths L of 0.15 to 1.00 mm. At a length L of 1.50 mm, toner blots occurred.

If the height H was 0.35 mm, the leading edge density stability was found to be poor (rank C) at a length L of 0.15 mm.

Next, the results of the end toner leakage will be described.

If the developing blade 21 had a height H of 0 mm to 0.10 mm in the sealing areas, no toner leakage occurred at all.

If the developing blade 21 had a height H of 0.15 mm to 0.30 mm in the sealing areas, toner leakage occurred. Other portions of the process cartridges were contaminated with the toner, and the interior of the image forming apparatuses was scattered with the toner.

Figure 13A:
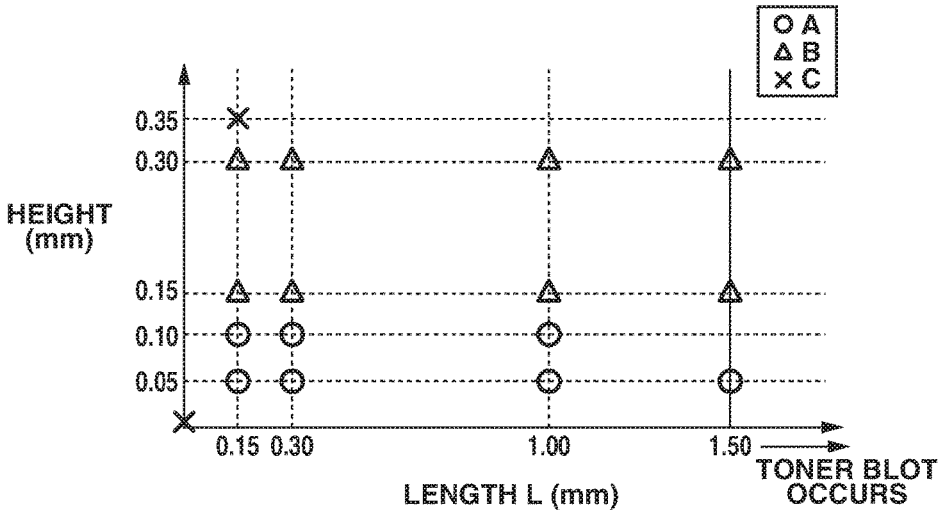
FIGS. 13A and 13B are charts illustrating evaluation results of the first exemplary embodiment.
Figure 13B:
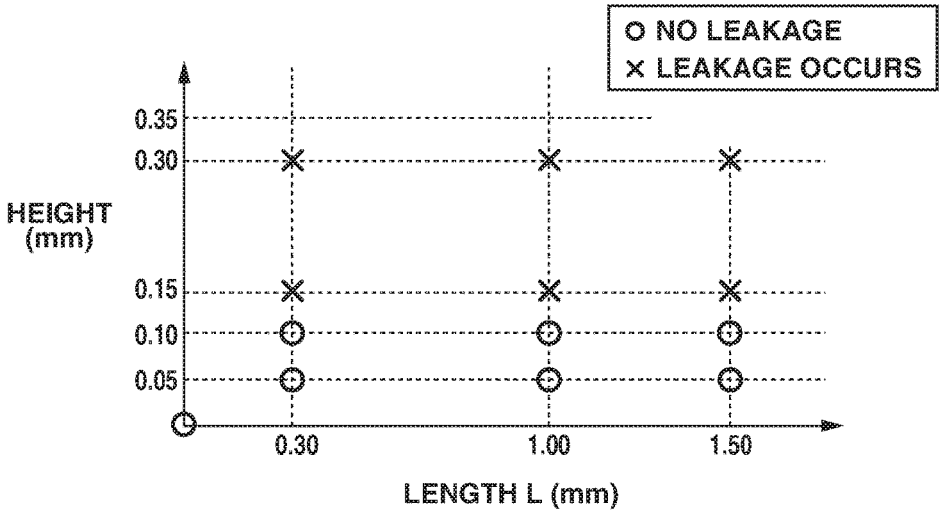

The foregoing results are summarized in the graphs of FIGS. 13A and 13B, with an appropriate range of developing blade configuration. FIG. 13A illustrates the evaluations of development ghosts and the evaluations of toner blots in the image forming area. FIG. 13B illustrates the results of toner leakage from the sealing areas. The horizontal axis of each graph indicates the length L (mm), and the vertical axis the height H (mm). In FIG. 13A, the samples with the leading edge density stability of "A" are represented by "o", those of "B" by "A", and those of "C" by "x". In summary, an appropriate range in terms of development ghosts is found to be such that the height H is greater than or equal to 0.05 mm and not greater than 0.30 mm and the length L is greater than or equal to 0.15 mm and not greater than 1.00 mm. In such a range, the leading edge density stability can be ranked as high as A, with a highest effect for improving development ghosts.

For the end toner leakage, an appropriate range of the height H in the sealing areas is found to be greater than or equal to 0 mm and not greater than 0.10 mm.

From the foregoing results, to improve development ghosts, a protrusion can be arranged on the tip part of the developing blade 21 so that areas of H=0 mm are formed between the image forming area and the respective sealing areas in the longitudinal direction of the developing blade 21. The height H of the protrusion can be set to be greater than or equal to 0.05 mm and not greater than 0.30 mm, and the length L can be set to be greater than or equal to 0.15 mm and not greater than 1.00 mm. To further prevent toner leakage, the height H in the seal areas can be set to be greater than or equal to 0 mm and not greater than 0.10 mm. A developing blade configuration satisfying such a shape can both improve development ghosts and prevent toner leakage.

[Modification]

Figure 14A:
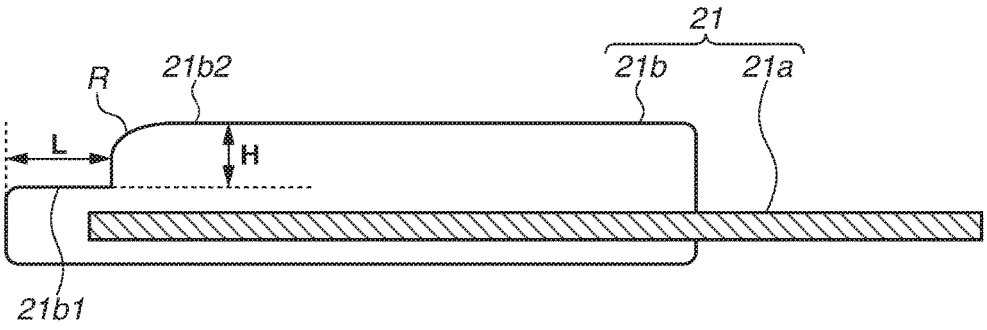
FIGS. 14A and 14B are diagrams illustrating a shape of a developing blade according to a modification of the first exemplary embodiment.

In the first exemplary embodiment, the protrusion protruding from the opposed surface 21*b*1 of the development blade 21 is formed to provide the contact surface 21*b*2 having a step of H (mm) in height. However, this is not restrictive. Any configuration may be employed as long as a predetermined range of nip width is formed between the blade portion 21*b* and the development roller 17 when the blade portion 21*b* is put in contact with the developing roller 17. For example, any configuration in which a nip width of 0.6 to 0.8 mm is formed when the blade portion 21*b* is put into contact with the development roller 17 by a force of 40 gf/cm may be employed. As illustrated in FIG. 14A, the opposed surface 21*b* to be opposed to the developing roller 17 may be formed by forming a step that descends by a height of H (mm) from the contact surface 21*b*2 which makes contact with the developing roller 17. In other words, the developing blade 21 may be configured to include the contact surface 21*b*2 and the opposed surface 21*b*1 that is formed by thinning the tip part of the blade portion 21*b*. In such a case, like the first exemplary embodiment, the portion leading to the contact surface 21*b*1 is configured to have a radius of curvature of R (mm).

Figure 14B:
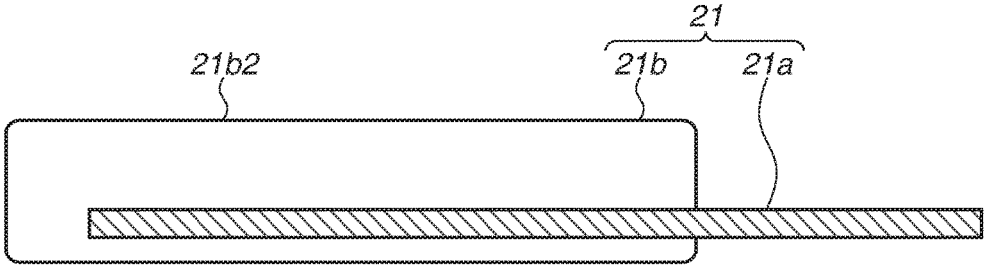

Like the first exemplary embodiment, the developing blade 21 is configured so that there is an area of H=0 mm between the image forming area and each sealing area where the developing blade 21 and the end seal 40 overlap. If the areas of H=0 mm are formed, as illustrated in FIG. 14B, the tip part of the blade portion 21*b* is configured to be flush with the contact surface 21*b*2 without a step.

Even in such a case, a height H of greater than or equal to 0.05 mm and not greater than 0.30 mm and a length L of greater than or equal to 0.15 mm and not greater than 1.00 mm can improve development ghosts. A height H of greater than or equal to 0 mm and not greater than 0.10 mm in the sealing areas can prevent toner leakage. A developing blade configuration satisfying such a shape can thus both improve development ghosts and prevent toner leakage.

In the present exemplary embodiment, an image forming apparatus capable of forming a color image has been described as an example. However, the present invention is not limited thereto. Similar effects can be obtained for an image forming apparatus capable of forming a monochrome image, having a configuration in which a toner supply roller using nonmagnetic one-component toner rotates in the same rotation direction as that of a developing roller.

In the first exemplary embodiment, the image forming apparatus is described to be a printer. However, the present invention is not limited thereto. For example, an exemplary embodiment of the present invention is applicable to other image forming apparatuses such as a copying machine and a facsimile apparatus, and multifunction peripherals and other image forming apparatuses having such functions in combination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-069284, filed Mar. 30, 2016, which is hereby incorporated by reference herein in its entirety.

What is claimed is:

1. A developing device used in an image forming apparatus, the developing device comprising:

a frame member including a developer accommodating chamber which accommodates a developer and includes an opening;

a developer bearing member rotatably supported by the frame member and facing the opening, configured to bear the developer;

a regulation member configured to contact with the developer bearing member and to regulate a thickness of the developer on the developer bearing member; and an end seal fixed to an end portion of the opening of the frame member in a longitudinal direction of the developer bearing member and configured to seal a gap between the frame member and the developer bearing member, the end seal having a sealing area, outside an image forming area, in which the end seal sandwiches an end portion of the regulation member with the developer bearing member in the longitudinal direction of the developer bearing member so as to seal a gap between the regulation member and the developer bearing roller, wherein the regulation member includes an opposed surface and a contact surface, the opposed surface being opposed to the developer bearing member with a space therebetween and being provided on a tip portion of the regulation member in a direction crossing the longitudinal direction of the developer bearing member, the contact surface contacting the developer bearing member, protruding further toward the developer bearing member than the opposed surface, and being aligned with the opposed surface in the direction crossing the longitudinal direction of the developer bearing member, wherein the contact surface of the regulation member is provided in the image forming area, and is not provided in the sealing area, and wherein the end seal is provided so as not to contact with a surface of the regulation member on which the contact surface is provided.

2. The developing device according to claim 1, wherein in the image forming area, the regulation member is configured so that a step between the opposed surface and the contact surface has a height greater than or equal to 0.05 mm and not greater than 0.30 mm, and a length of the opposed surface of the regulation member from a tip of the tip portion to the contact surface in the direction crossing the longitudinal direction of the developer bearing member is greater than or equal to 0.15 mm and not greater than 1.00 mm.

3. The developing device according to claim 1, wherein the developer accommodation chamber is arranged below the developer bearing member, and wherein the developing device further comprises a conveyance member configured to convey the developer accommodated in the developer accommodation chamber to the developing chamber, the conveyance member being configured to rotate faster than a peripheral speed of the developer bearing member.

4. The developing device according to claim 1, further comprising:

a supply member configured to supply the developer by rotating so that its surface moves in the same direction as that in which a surface of the developer bearing member does, in a nip portion formed by contact with the developer bearing member.

5. The developing device according to claim 1, wherein the end seal is bonded to the frame member.

6. The developing device according to claim 1, wherein the developer accommodated in the frame member is nonmagnetic one-component toner.

7. The developing device according to claim 1, wherein in an area of the regulation member between the image forming area and the end sealing area, a height of a step between the opposed surface and the contact surface becomes smaller as it gets closer to the sealing area in the longitudinal direction of the developer bearing member.

8. The developing device according to claim 1, the regulation member includes a blade formed of a resin and a supporting plate supporting the blade, the opposed surface and the contact surface are surfaces of the blade.

9. A developing device used in an image forming apparatus, the developing device comprising:

a frame member including a developer accommodating chamber which accommodates a developer and includes an opening;

a developer bearing member rotatably supported by the frame member and facing the opening, configured to bear the developer;

a regulation member including a blade formed of a resin and a supporting plate supporting the blade, configured to contact with the developer bearing member and to regulate a thickness of the developer on the developer bearing member; and an end seal fixed to an end portion of the opening of the frame member in a longitudinal direction of the developer bearing member and configured to seal a gap between the frame member and the developer bearing member, the end seal having a sealing area, outside an image forming area, in which the end seal sandwiches an end portion of the regulation member with the developer bearing member in the longitudinal direction of the developer bearing member so as to seal a gap between the regulation member and the developer bearing roller, wherein the blade of the regulation member includes an opposed surface and a contact surface, the opposed surface being opposed to the developer bearing member with a space therebetween and being provided on a tip portion of the regulation member in a direction crossing the longitudinal direction of the developer bearing member, the contact surface contacting the developer bearing member, protruding further toward the developer bearing member than the opposed surface, and being aligned with the opposed surface in the direction crossing the longitudinal direction of the developer bearing member, wherein the contact surface of the blade is provided in the image forming area, and is not provided in the sealing area.

10. The developing device according to claim 9, wherein in an area of the regulation member between the image forming area and the end sealing area, a height of a step between the opposed surface and the contact surface becomes smaller as it gets closer to the sealing area in the longitudinal direction of the developer bearing member.

11. The developing device according to claim 9, wherein the developer accommodation chamber is arranged below the developer bearing member, and wherein the developing device further comprises a conveyance member configured to convey the developer accommodated in the developer accommodation chamber to the developing chamber, the conveyance member being configured to rotate faster than a peripheral speed of the developer bearing member.

12. The developing device according to claim 9, further comprising:

a supply member configured to supply the developer by rotating so that its surface moves in the same direction as that in which a surface of the developer bearing member does, in a nip portion formed by contact with the developer bearing member.

* * * * *